US006939032B2

(12) United States Patent
Cosby et al.

(10) Patent No.: US 6,939,032 B2
(45) Date of Patent: Sep. 6, 2005

(54) COVER SLIP MIXING APPARATUS

(75) Inventors: N. Guy Cosby, Dover, NH (US); David J. Moore, Dover, NH (US); Jim Clements, Brentwood, NH (US)

(73) Assignee: Erie Scientific Company, Portsmouth, NH (US)

( * ) Notice: Subject to any disclaimer, the term of this patent is extended or adjusted under 35 U.S.C. 154(b) by 98 days.

(21) Appl. No.: 10/280,676

(22) Filed: Oct. 25, 2002

(65) Prior Publication Data

US 2003/0107946 A1 Jun. 12, 2003

Related U.S. Application Data

(60) Provisional application No. 60/336,282, filed on Oct. 25, 2001.

(51) Int. Cl.[7] ..... B01F 11/00; B01F 13/08

(52) U.S. Cl. ..... 366/114; 366/273; 366/274; 366/275; 422/102; 422/225; 435/303.3

(58) Field of Search ..... 366/DIG. 1–DIG. 4, 366/108, 114, 115, 273–275; 137/896; 417/322, 413.1; 251/129.17, 331; 422/102, 225; 435/303, 3

(56) References Cited

U.S. PATENT DOCUMENTS

| | | | | |
|---|---|---|---|---|
| 3,034,761 A | * | 5/1962 | Janquart | 251/210 |
| 3,572,892 A | | 3/1971 | Metzgar et al. | |
| 3,879,106 A | | 4/1975 | McCormick | |
| 3,960,268 A | | 6/1976 | Davis et al. | |
| 4,022,521 A | | 5/1977 | Hall et al. | |
| 4,119,120 A | * | 10/1978 | Mehaffy et al. | 137/885 |
| 4,260,392 A | | 4/1981 | Lee | |
| 4,447,140 A | | 5/1984 | Campbell et al. | |
| 4,481,246 A | | 11/1984 | Melisz et al. | |
| 4,501,496 A | | 2/1985 | Griffin | |
| 4,595,561 A | | 6/1986 | Thornton et al. | |

(Continued)

OTHER PUBLICATIONS

Erie Scientific Company. *Microscope Slides and Cover Glass Dealer Price List*. Oct. 1, 2000.

Erie Scientific Company. *Brochure for a: Lifter SlipTM Premium Printed Cover Glass*.

Specification sheet for a: HYBRIWELL sealing system.

Instructions for use for a HYBRIWELL.

Detailed drawing of a glass product sold by Erie Scientific at least since 1999.

Specification sheet for a: Cover Glass (Borosilicate Glass).

"Basic Microfluidic Concepts". http://faculty.washington.edu/yagerp/microfluidicstutorial/basicconcepts/basicconcepts.htm. revised on Sep. 7, 2001.

"Handling Fluids in Microsensors". http://www.llnl.gov/str/Miles.html. Science & Technology Review 1999.

"Microfludics". http://www.cfdrc.com/datab Applications/microelectronics/Microfluidics/microfluidics.htm. downloaded Oct. 18, 2002.

"ESCO Technical Information". http://www.eriesci.com/tech_info/DNA_proto.html. downloaded Oct. 18, 2001.

(Continued)

*Primary Examiner*—David L. Sorkin

(74) *Attorney, Agent, or Firm*—Wood, Herron & Evans, L.L.P.

(57) ABSTRACT

A cover slip mixing apparatus having a support and a flexible cover slip positioned over and forming a chamber between the support and the cover slip. A device is positioned with respect to the support and cover slip for applying a force on the cover slip and flexing the cover slip toward the support, the flexing cover slip providing a mixing action of a material located in the chamber. A microfluidic device includes a substrate with a fluid path disposed in the substrate. A flexible cover is positioned over the substrate and the fluid path, and a device is positioned with respect to the substrate and the cover. The device is operable to apply forces to the cover and flex the cover to act on fluid in the fluid path.

13 Claims, 3 Drawing Sheets

U.S. PATENT DOCUMENTS

| | | | | | |
|---|---|---|---|---|---|
| 4,624,882 | A | | 11/1986 | Melisz et al. | |
| 4,647,543 | A | | 3/1987 | Stocker | |
| 4,679,914 | A | | 7/1987 | Rosenberg | |
| 4,731,335 | A | | 3/1988 | Brigati | |
| 4,777,020 | A | | 10/1988 | Brigati | |
| 4,793,714 | A | * | 12/1988 | Gruber | 366/150.1 |
| 4,826,131 | A | * | 5/1989 | Mikkor | 251/129.17 |
| 5,002,736 | A | | 3/1991 | Babbitt et al. | |
| 5,349,436 | A | | 9/1994 | Fisch | |
| 5,571,721 | A | | 11/1996 | Turner | |
| 5,681,741 | A | | 10/1997 | Atwood et al. | |
| 5,812,312 | A | | 9/1998 | Lorincz | |
| 5,842,787 | A | * | 12/1998 | Kopf-Sill et al. | 366/340 |
| 5,939,251 | A | | 8/1999 | Hu | |
| 6,033,628 | A | * | 3/2000 | Kaltenbach et al. | 422/68.1 |
| 6,089,538 | A | * | 7/2000 | Shirkhan | 251/129.17 |
| 6,116,863 | A | * | 9/2000 | Ahn et al. | 417/322 |
| 6,180,314 | B1 | | 1/2001 | Berndt | |
| 6,413,783 | B1 | * | 7/2002 | Wohlstadter et al. | 436/517 |
| 6,420,114 | B1 | * | 7/2002 | Bedilion et al. | 435/6 |
| 6,485,918 | B1 | * | 11/2002 | Schermer et al. | 435/6 |
| 6,555,361 | B1 | * | 4/2003 | Lyman et al. | 435/287.2 |
| 6,613,560 | B1 | * | 9/2003 | Tso et al. | 435/287.2 |
| 2003/0210607 | A1 | * | 11/2003 | Gilbert et al. | 366/152.1 |

OTHER PUBLICATIONS

"Microarrays", http://bldg6.arsusda.gov/benlab/microarrays.htm, downloaded Oct. 15, 2001.

"DNA Microarray Information Sheet (Mar. 1999)". http://www.zmdb.lastate.edu/zmdb/microarray.html. downloaded Aug. 20, 2001.

"DNA–Arrays.com" home page. http://www.dna–arrays.com. downloaded Oct. 15, 2001.

Brian White. MIT. Copyright 1995, "Southerns. Northerns. Westerns. & Cloning: "Molecular Searching" Techniques", http://cyberbio.mit.edu:8001/esgbio/rdna/rdna.html. downloaded Oct. 19, 2001.

"Micro–Electro–Mechanical Systems (MEMS) Application CFDRC", http://www.cfdrc.com/datab/Applications/MEMS/mems.html. downloaded Oct. 18, 2002.

"Biological/Chemical Microsystems", http://www.cldrc.com/datab/Applications/MEMS/biomems/biomems.html. downloaded Oct. 18, 2002.

"HybChamber™" Product Advertisement. http://www.genemachines.com/HybChambers.html. downloaded Jul. 9, 2001.

"CMT™–Hybridization Chamber" Product Advertisement, http://www.corning.com/CMT/Products/Hybridization.asp. downloaded Jul. 9, 2001.

TeleChem International. Inc. //arrayit.com. "Hybridization Cassettes Handbooks" Product Advertisement, http://arrayit.com/Products/hybrid_Products/Hyb_Cassettes/hyb cassettes.html, downloaded Jul. 9, 2001.

* cited by examiner

COVER SLIP MIXING APPARATUS

This application claims the benefit of U.S. Provisional Application No. 60/336,282, entitled "Cover Slip Mixing Apparatus and Method", filed Oct. 25, 2001.

FIELD OF THE INVENTION

This invention relates to a glass cover slip and support assembly used in hybridization methods that provides mixing of the hybridization solution.

BACKGROUND OF THE INVENTION

Molecular searches use one of several forms of complementarity to identify the macromolecules of interest among a large number of other molecules. Complementarity is the sequence-specific or shaped-specific molecular recognition that occurs when two molecules bind together. Complementarity between a probe molecule and a target molecule can result in the formation of a probe-target complex. This complex can then be located if the probe molecules are tagged with a detectible entity such as a chromophore, fluorophore, radioactivity, or an enzyme. There are several types of hybrid molecular complexes that can exist. A single-stranded DNA (ssDNA) probe molecule can form a double-stranded, base pair hybrid with an ssDNA target if the probe sequence is the reverse complement of the target sequence. An ssDNA probe molecule can form a double-stranded, base-paired hybrid with an RNA target if the probe sequence is the reverse complement of the target sequence. An antibody probe molecule can form a complex with a target protein molecule if the antibody's antigen-binding site can bind to an epitope on the target protein. There are two important features of hybridization reactions. First, the hybridization reactions are specific in that the probes will only bind to targets with a complementary sequence, or in the case of proteins, sites with the correct three-dimensional shape. Second, hybridization reactions will occur in the presence of large quantities of molecules similar but not identical to the target. A probe can find one molecule of a target in a mixture of a zillion of related but non-complementary molecules.

There are many research and commercially available protocols and devices that use hybridization reactions and employ some similar experimental steps. For example microarray (or DNA chip) based hybridization uses various probes which enable the simultaneous analysis of thousands of sequences of DNA for genetic and genomic research and for diagnosis. Most DNA microarray fabrications employ a similar experimental approach. The probe DNA with a defined identity is immobilized onto a solid medium. The probe is then allowed to hybridize with a mixture of nucleic acid sequences, or conjugates, that contain a detectable label. The signal is then detected and analyzed. Variations of this approach are available for RNA-DNA and protein-protein hybridizations and those hybridization techniques involving tissue sections that are immobilized on a support. In all of these protocols, the hybridization solution is placed directly on the support that contains the immobilized DNA or tissue section.

The hybridization reaction is usually performed in a warm environment and there are several ways to prevent evaporation and inadvertent contamination of the hybridization solution that is on the support. Cover slips have been placed directly on the solution, but the weight of the cover slip displaces the solution and minimizes the amount of solution that is in contact with the immobilized component. Devices are commercially available that form a chamber around the support to allow a desired volume of hybridization solution to be placed on the support. The support is then completely covered. With these devices, there is a problem of hybridization non-uniformity due to formation of concentration gradients resulting in unevenly dispersed conjugates. Thus, there is a desire to form a chamber that provides even dispersal throughout the hybridization solution during the reaction process.

Microfluidic devices are now being used to conduct biomedical research and create clinically useful technologies having a number of significant advantages. First, because the volume of fluids within these channels is very small, usually several nanoliters, the amount of reagents and analytes used is quite small. This is especially significant for expensive reagents. The fabrications techniques used to construct microfluidic devices are relatively inexpensive and are very amenable both to highly elaborate, multiplexed devices and also to mass production. In a manner similar to that for microelectronics, microfluidic technologies enable the fabrication of highly integrated devices for performing several different functions on the same substrate. Common fluids used in microfluidic devices include whole blood samples, bacterial cell suspensions, protein or antibody solutions and various buffers. Microfluidic devices can be used to obtain a variety of interesting measurements including molecular diffusion coefficients, fluid viscosity, pH, chemical binding coefficients, and enzyme reaction kinetics. Other applications for microfluidic devices include capillary electrophoresis, isoelectric focusing, immunoassays, flow cytometry, sample injection of proteins for analysis via mass spectrometry, PCR amplification, DNA analysis, cell manipulation, cell patterning, and chemical gradient formation.

SUMMARY OF THE INVENTION

The present invention provides a mixing apparatus that substantially improves the quality of a mixing action. The mixing apparatus of the present invention causes a mixing action that eliminates gradients or conjugates that occur in nonmixed solutions. The mixing apparatus of the present invention allows conjugates and other elements in the solution to move and disperse evenly throughout the fluid and bind or hybridize to an immobilized material. This results in increased data quality during the analysis of the hybridized immobilized material. The present invention further provides a structure for a microfluidic device that permits the mixing and/or pumping of fluids therethrough.

According to the principles of the present invention and in accordance with the described embodiments, the invention provides a cover slip mixing apparatus having a support and a flexible cover slip positioned over and forming a chamber between the support and the cover slip. A device is positioned with respect to the support and cover slip for applying a force against the cover slip and flexing the cover slip toward the support, the flexing cover slip providing a mixing action of a material located in the chamber. In one aspect of this invention, the device is a magnetizable component mounted on the cover slip and a magnet positioned to provide a magnetic field that passes through the magnetizable component.

In another embodiment of the invention, a microfluidic device includes a substrate with a fluid path disposed in the substrate. A flexible cover is positioned over the substrate and the fluid path, and a device is positioned with respect to the substrate and the cover. The device is operable to apply forces to the cover and flex the cover to act on fluid in the fluid path.

In one aspect of this invention, a magnetizable component is disposed on the cover, and the device is operable to apply forces on the cover and oscillate the cover to act on the fluid in the channel. In another aspect of this invention, the fluid path has a plurality of inlet channels fluidly connected to respectively different fluid sources, a pumping chamber fluidly connected to the plurality of inlet channels and an outlet channel fluidly connected to the pumping chamber. The cover is oscillated to mix the fluids in the pumping chamber and/or pump the fluids along the fluid path.

These and other objects and advantages of the present invention will become more readily apparent during the following detailed description taken in conjunction with the drawings herein.

DETAILED DESCRIPTION OF THE INVENTION

Figure 1:
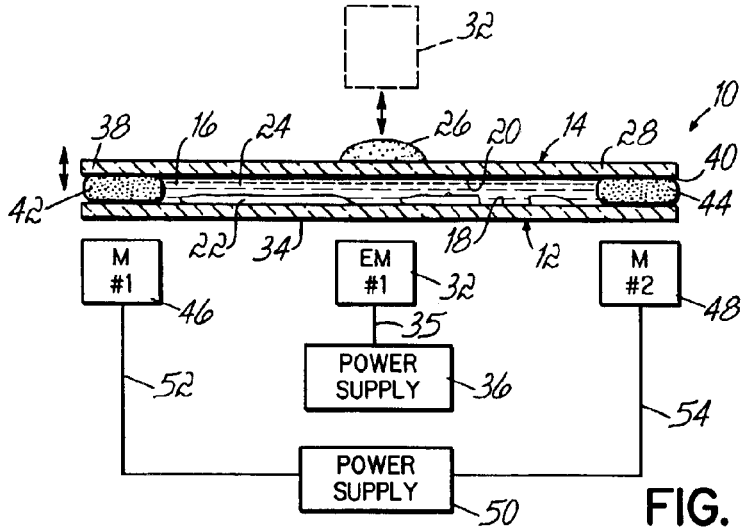
FIG. 1 is a schematic side view of a cover slip mixing apparatus in accordance with the principles of the present invention.
Figure 2:
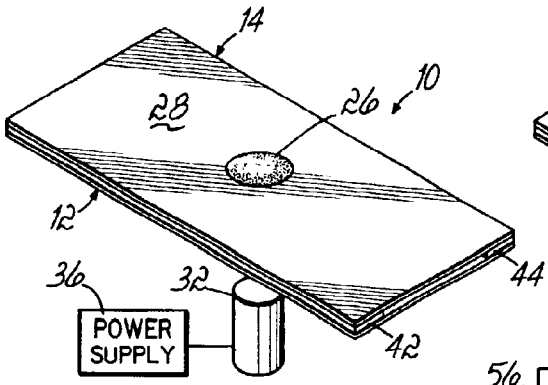
FIG. 2 is a schematic perspective view of one embodiment of the cover slip mixing apparatus of FIG. 1.

Referring to FIG. 1, a cover slip mixing apparatus 10 includes a support 12 and a cover slip 14. The support 12 may be any material suitable for the reaction being conducted, for example, a DNA chip, microarray, a glass slide, such as a microscope slide, or other types of suitable support used in hybridization methods. The cover slip 14 is made from a flexible material, for example, glass. Glass suitable for use as a cover slip is currently commercially available in thicknesses of about 0.012 mm (0.0005 inches) –1 mm (0.040 inches). As will be appreciated, other thicknesses of glass may be used as such are commercially available. Support bars 42, 44 are disposed along two or more edges, for example, edges 38, 40 on an inner surface 20 of the cover slip 14. The support bars 42, 44 maintain the cover slip 14 a desired distance above the support 12 and form a chamber 16 between an inner surface 18 of the support 12 and an opposing inner surface 20 of the cover slip 14. The chamber 16 has at least one open end between the support bars 42, 44 as shown in FIG. 2 and thus, is an unsealed chamber.

The support bars 42, 44 are formed by a strip of ink printed on the support inner surface 18. The ink bars are printed with a commercially available ink using an SMT printer commercially available from Affiliated Manufacturers, Inc. of North Branch, N.J. With such a screen printing process, the maximum height that can be obtained in a single printed bar is limited by the ink being used. For example, using an ink that is used to provide a frosted coating label or indicia portion at an end of a microscope slide, an ink bar having a thickness in a range of about 0.030–0.040 mm can be printed on the cover slip. If a greater thickness is required, a second ink bar can be printed over the first ink bar to provide a thickness of about 0.050–0.060 mm. Alternatively, the support bars 42, 44 can be made from filled inks, double sided tape, etc.

The chamber 16 often contains an immobilized material 22, for example, a tissue sample, DNA or other hybridizable material. Other hybridizable materials include isolated RNA and protein, and human, animal and plant tissue sections containing DNA, RNA, and protein that are used for research and diagnostic purposes. The chamber 16 also contains a fluid 24, for example, a liquid hybridization solution.

A magnetic or magnetizable component 26 is disposed on an outer surface 28 of the cover slip 14. The magnetizable component 26 contains a magnetic or magnetizable material that may be in the form of a liquid, powder, granule, microsphere, sphere, microbead, microrod, or microsheet. One example of the magnetizable component 26 is a ferromagnetic ink that is made by mixing a stainless steel powder and ink. An example of the stainless steel powder is a 400 series powder, commercially available from Reade Advanced Materials of Providence, R.I. The ink is any commercially available ink that is formulated to adhere to glass. The ferromagnetic ink is made by mixing the stainless steel powder with the ink. The precise concentration of powder in the ink can be determined by one who is skilled in the art and will vary depending on the thickness of the cover slip 14, the geometry of the magnetic component 26 and other application dependent variables. It has been determined that a concentration of powder in the ink may be about 20–60 percent by weight. The magnetizable component 26 often takes the form of a dot or spot but can be any size or shape depending on the thickness of the cover slip 14, the mixing action desired and other factors relating to the application.

An electromagnet 32 is disposed at a location such that an electromagnetic field from the electromagnet 32 passes through the magnetic component 26. The electromagnet 32 may be located adjacent an outer surface 34 of the support 12. Alternatively, the electromagnet 32 may be located above the magnetic component 26 as shown in phantom. The electromagnet 32 is electrically connected to an output 35 of a power supply 36 that includes controls for selectively providing a variable output current in a known manner. The power supply 36 may include controls that also vary the frequency and amplitude of the output current. Therefore, when the power supply 36 is turned on, the electromagnet 32 provides an oscillating magnetic field passing through the magnetic component 26. The cover slip 14 is sufficiently thin that it flexes with the oscillations of the magnetic field, thereby providing a mixing action of the liquid 24.

The flexing of the cover slip 14 is controllable and variable. For example, during a first portion of a magnetic field oscillation, the cover slip 14 may flex inward toward the support 12 to create a concave exterior surface 28 and a convex interior surface 20. During another portion of the magnetic field oscillation, the cover slip 14 flexes in the opposite direction. Depending on the output current provided from the power supply 36, the cover slip 14 may flex back to a position short of its original position, to its original position or to a position beyond its original position. For example, the cover slip 14 could flex outward away from the support 12 to create a convex outer surface 28 and a concave inner surface 20. Further, by varying the frequency and amplitude of the output current, the frequency and amplitude of the oscillations of the cover slip 14 can be changed. The objective is to provide one or more mixing patterns of the fluid 24 within the chamber 16 that provide an even dispersal of the components within the chamber 16.

As will be appreciated, the mixing action provided by the magnetizable component 26 varies as a function of the size, number and location of magnetizable components on the cover slip outer surface 28. For example, referring to FIG. 2, in one embodiment of the cover slip mixing apparatus 10, the cover slip outer surface 28 may have only a single magnetizable component 26. A power supply 36 selectively supplies an output current to an electromagnet 32 that, in turn, induces a magnetic field into the magnetizable component 26, thereby flexing the cover slip 14 and mixing the fluids in the chamber 16.

Figure 3:
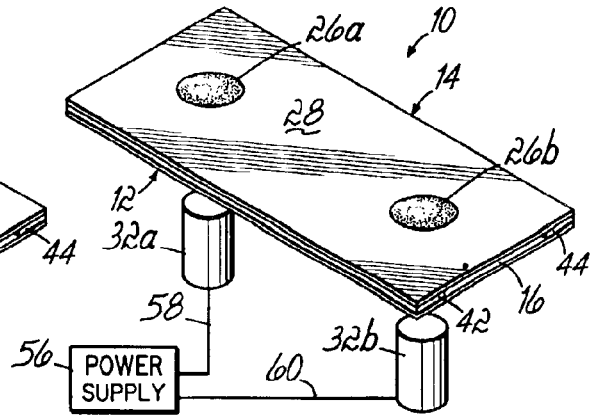
FIG. 3 is a schematic perspective view of a second embodiment of the cover slip mixing apparatus of FIG. 1.

In a second embodiment of the cover slip mixing apparatus 10 illustrated in FIG. 3, two magnetizable components 26*a*, 26*b* are located on the cover slip outer surface 28. A power supply 56 is electrically connected via outputs 58, 60 to first and second electromagnets 32*a*, 32*b*. The electromagnets 32*a*, 32*b* are located with respect to the magnetic components 26*a*, 26*b* such that when energized by the power supply 56, the electromagnets 32*a*, 32*b* induce a magnetic field in respective magnetizable components 26*a*, 26*b*. The output current from the power supply 56 can be controlled such that the electromagnetic fields from the respective electromagnets 32*a*, 32*b* produce mechanical forces on the magnetizable components 26*a*, 26*b* that are in-phase. Such forces cause portions of the cover slip 14 under the magnetic components 26*a*, 26*b* to move substantially simultaneously in the same direction. Such in-phase motion of those portions of the cover slip 14 will produce a first mixing action in the chamber 16.

A different mixing pattern can be produced by adjusting the power supply 56 such that the electromagnetic fields from the respective electromagnets 32*a*, 32*b* produce mechanical forces on the magnetizable components 26*a*, 26*b* that are out-of-phase. Such forces cause portions of the cover slip 14 under the magnetic components 26*a*, 26*b* to move substantially simultaneously in opposite directions. In both examples above, if current signals on the outputs 58, 60 are substantially identical in amplitude and frequency, the motion of the portions of the cover slip 14 beneath the magnetic components 26*a*, 26*b* will also be substantially identical. However, any difference in the amplitude and frequency on the outputs 56, 58 will result in different motions of the portions of the cover slip 14 beneath the magnetic components 26*a*, 26*b*. Hence, as will be appreciated, almost any mixing pattern can be achieved within the chamber 16 by adjusting frequency and/or amplitude of one or both of the outputs 56, 58 from the power supply 56.

Figure 4:
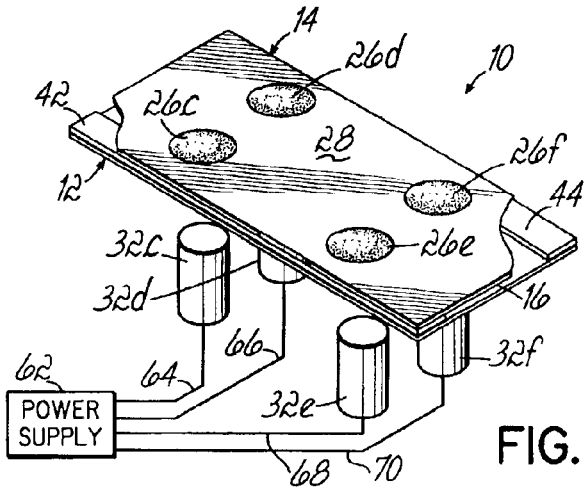
FIG. 4 is a schematic perspective view of a third embodiment of the cover slip mixing apparatus of FIG. 1.

Referring to FIG. 4, in a third embodiment of the cover slip mixing apparatus 10, a first pair of magnetizable components 26*c*, 26*d* are located on one half of the cover slip outer surface 28, and a second pair of magnetizable components 26*e*, 26*f* are located on the other half of the cover slip outer surface 28. A power supply 62 is electrically connected to electromagnets 32*c*, 32*d*, 32*e*, 32*f*, via respective outputs 64, 66, 68, 70. The electromagnets 32*c*, 32*d*, 32*e*, 32*f* are located with respect to the magnetic components 26*c*, 26*d*, 26*e*, 26*f* such that when energized by the power supply 62, the electromagnets 26*c*, 26*d*, 26*e*, 26*f* induce a magnetic field in the respective magnetizable components 26*c*, 26*d*, 26*e*, 26*f*.

Any pair of the electromagnets 32*c*, 32*d*, 32*e*, 32*f* can be operated in unison so that a respective pair of the magnetizable components 26*c*, 26*d*, 26*e*, 26*f* provide a greater flexing force on those portions of the cover slip 14 beneath the pair of magnetic components being operated in unison. Such a greater force may be desirable for a cover slip having a greater thickness; and/or the greater force may be required if the liquid 24 within the chamber 16 has a greater viscosity. Alternatively, the electromagnets 32*c*–32*f* may be operated with output currents of different phase and/or amplitude such that the resulting forces on the cover slip 14 provide a random mixing action or pattern within the chamber 16.

Figure 5:
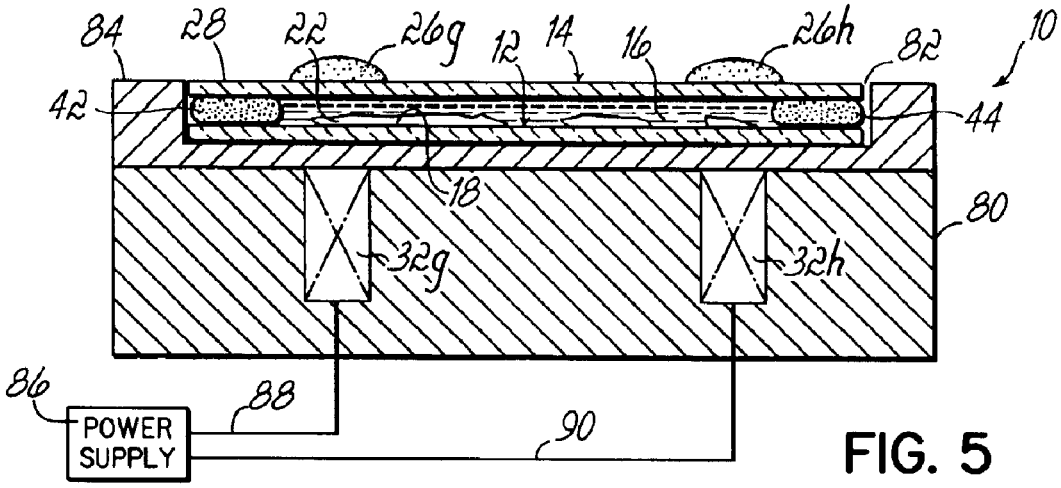
FIG. 5 is a schematic perspective view of a fourth embodiment of the cover slip mixing apparatus of FIG. 1.

FIG. 5 illustrates a fourth embodiment of the cover slip mixing apparatus 10. A base 80 is made from any nonmagnetic rigid material, for example, aluminum or plastic. A cavity 82 is formed in an upper surface 84 of the base 80. The cavity 82 is sized to receive a support 12 and cover slip 14. One or more magnetizable components 26*g*, 26*h* are located on the cover slip outer surface 28. A power supply 86 is electrically connected via outputs 88, 90 to one or more electromagnets 32*g*, 32*h*. The electromagnets 32*g*, 32*h* are located with respect to the magnetic components 26*g*, 26*h* such that when energized by the power supply 86, the electromagnets 32*g*, 32*h* induce a magnetic field in respective magnetizable components 26*g*, 26*h*. The power supply 86, electromagnets 32*g*, 32*h* and magnetic components are operated as described with respect to the other embodiments in order to provide a desired mixing action within the chamber 16.

Referring to FIG. 1, the cover slip 14 can be maintained stationary on the support 12 in a known manner by forces of a capillary action of the hybridization solution 24. However, in some applications, a more secure mounting of the cover slip 14 over the support 12 may be desired. The cover slip mixing apparatus 10 includes an alternative structure for maintaining the cover slip 14 stationary over the support 12. In this embodiment, a magnetizable material is mixed with the ink forming the support bars 42, 44 to produce magnetizable support bars 42, 44. The magnetizable support bars 42, 44 can be made from the same material that is used to provide the magnetic component 26. First and second magnets 46,48 are disposed adjacent the support exterior surface 34 and are generally aligned with the respective support bars 42, 44. The magnets 46, 48 may be permanent magnets; or alternatively, the magnets 46, 48 may be electromagnets that are connected to a power supply 50 via outputs 52, 54. The power supply includes controls for selectively providing an output current, for example, a DC current, to the magnets 46, 48. Upon the power supply 50 supplying current to the magnets 46, 48, magnetic fields are induced into the respective support bars 42, 44 that pull the support bars 42, 44 and the cover slip 14 against the support inner surface 18. Thus, the cover slip 14 is secured and maintained in a stationary position with respect to the support 12.

In use, referring to FIG. 1, many hybridization reactions involving DNA, RNA and protein components or conjugates can be performed on the support interior surface 18. A material 22, for example, DNA, a microarray of DNA, a tissue section or other material under study, is immobilized on the support interior surface 18, and a hybridization solution 24 is placed on the material. A cover slip 14 is then placed over the hybridization fluid 24. A power supply 36 is then turned on and a current on output 35 causes an electromagnet 32 connected to the power supply 36 to produce a magnetic field. The magnetic field passes through the magnetizable component 26 on the cover slip 14 and causes a force to be applied against a portion of the cover slip outside surface 28 beneath the magnetizable component 26. The force flexes the cover slip 14 toward and away from the support 14.

While any flexing of the cover slip 14 results in some mixing action, as will be appreciated, the thickness of the chamber 16 between the cover sip 14 and the support 12 may be quite small, for example, about 0.001 inches. Thus, a flexing of the cover slip 14 at a single location has limited mixing capability. A greater liquid flow and mixing action may be achieved by utilizing a plurality of magnetizable components 26 in a pattern on the cover slip 14. Further, the electromagnets 32 associated with those components can be energized in a pattern such that the flexing moves in a pattern around the cover slip. In one such a pattern, the flexing action moves in a closed loop around the cover slip. With such a flexing pattern the mixing action of the liquid 24 is substantially improved. In addition, flow channels may be etched into the underside of the cover slip 14 to facilitate a mixing action.

That flexing motion causes a mixing of the hybridization solution 24 and eliminates gradients or conjugates that occur in nonmixed solutions. The mixing allows conjugates and other elements in the solution to move and disperse evenly throughout the fluid and bind or hybridize to the immobilized material 22, such as DNA. This results in increased data quality during the analysis of the hybridized immobilized material.

Figure 7:
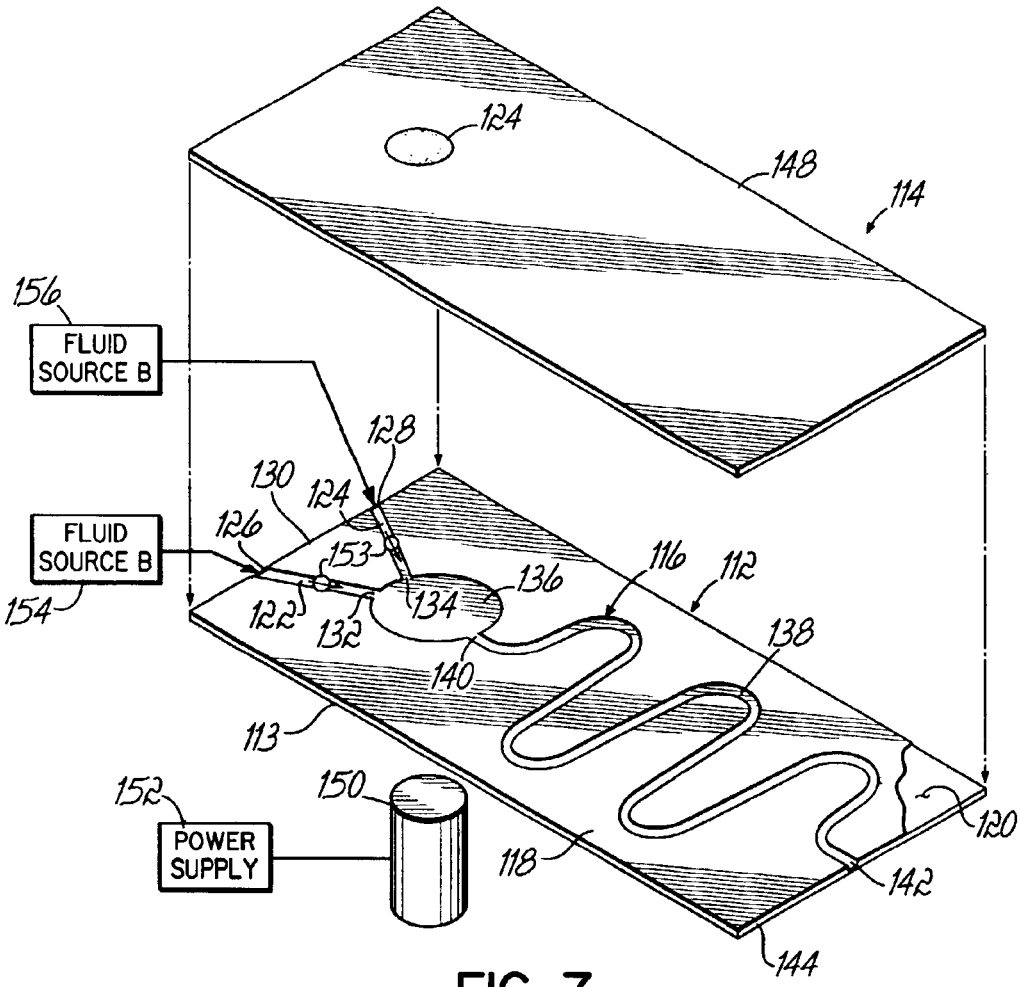
FIG. 7 is a schematic perspective view of a microfluidic device in accordance with the principles of the present invention.

In a still further embodiment of the invention, referring to FIG. 7, a microfluidic device 110 is comprised of a substrate 112 and a cover 114 that can be placed over the substrate 112. The substrate 112 has a base 113 that can be made of any material suitable for the application to which the microfluidic device 110 is being used, for example, a glass slide, etc. The size of the substrate 112 will be dependent on the application of the device 110. A fluid path 116 is disposed within a channeled layer 118 that is applied to an upper surface 120 of the base 113. The fluid path 116 contains two entry channels 122, 124 that have respective inlet ends 126,128 located at one end 130 of the substrate 112. The entry channels 122,124 have respective outlet ends 132, 134 that intersect a pumping chamber 136. A serpentine channel 138 has an inlet end 140 intersecting the chamber 136 and an outlet end 142 located at an opposite end 144 of the substrate 112. The serpentine channel 138 can function as a mixing coil. The channeled layer 118 that contains the fluid path 116 can be formed by any applicable technique, for example, by printing a layer of ink on the substrate upper surface 120 in a manner similar to that previously described with respect to the support bars 42,44. In one embodiment, a layer of ink is printed over the entire substrate upper surface 120, and the fluid path 116 is formed with a laser. The height and width of the channels comprising the fluid path 116 vary depending on many factors, for example, the viscosity and other physical characteristics of the fluid passing therethrough, the nature of the application of the device 110, etc. Thus, the height and width of the channels of the fluid path 116 are often determined experimentally.

A magnetic component 146, for example, a permanent magnet or a magnetizable component, is disposed on an outer directed or upper surface 148 of the cover 114. As a magnetizable component, the magnetic component 146 is similar in construction to the magnetizable component 26 shown and described with respect to FIG. 1 and the other figures. An electromagnet 150 is disposed at a location such that an electromagnetic field from the magnet 150 passes through the magnetic component 26. The electromagnet 150 is connected to a power supply 152 that includes controls for selectively providing a variable output current, in a known manner. The power supply 152 may also include controls that vary the frequency and amplitude of the current. Therefore, when the power supply 152 is turned on, the electromagnet 150 provides an oscillating magnetic field passing through the magnetic component 146. The magnetic component 146 can be sized to have an area smaller than a cross-sectional area of the pumping chamber 136, that is, smaller than an area of the cover 114 bounded by the pumping chamber 136. The cover 114 is sufficiently thin that the area over the chamber 136 vibrates or oscillates and flexes with the oscillations of the magnetic field. In some applications, the cover 114 can be etched or scored to facilitate a flexing of the area of the cover 114 over the chamber 136.

In use, after the channeled layer 118 is printed on the base 113 to form the fluid path 116, the cover 114 is placed over the substrate 112. The entry path inlet ends 126, 128 are then fluidly connected to fluid source A 154 and fluid source B 156, respectively. In this embodiment, check valves 153 are formed in the inlet channels 122, 124, so that a back flow of the fluid is prevented. As will be appreciated, alternatively, check valves, can also be placed in the fluid lines connecting the fluid sources 154, 156 to the respective inlet ends 126, 128. The power supply 152 is then turned on to energize the electromagnet 150 and cause the magnetizable component 146 to apply mechanical forces to the cover 114 in an area immediately under the magnetizable component 146. Those forces vibrate and flex the area of the cover 114 over the chamber 136. That flexing of the cover 114 assists the pumping of the fluids from the fluid sources 154, 156, through the respective inlet channels 122, 124 and into the chamber 136. Continued oscillations of the cover 114 effects a mixing of the fluids in the pumping chamber, and further oscillations of the cover 114 facilitate the pumping or flow of the fluid from the chamber 136 through the serpentine path 138 and through the outlet end 142.

Thus, using the microfluidic device 110, fluid can be pumped from a source and along a fluid path 116. Further, two fluids can be pumped from respective sources 154, 156 and into a chamber 136 where they are mixed. The mixed fluids are then pumped to an outlet end 142. That process is self-contained and is in contact only with glass. Although a serpentine path 138 is shown, as will be appreciated, other path shapes may be used depending on the application of the device 110. As will be appreciated, the embodiment of FIG. 7 can be expanded to include multiple mixing coils and pumping chambers having respective magnets as earlier described with respect to FIGS. 3 and 4. For example, the mixed fluid from pumping chamber 136 can be transferred by the mixing coil 138 to a second chamber that has another inlet connected to a third fluid source. Further, the second pumping chamber can have a second magnetizable element and magnet; and thus, using the principles of the invention shown in FIG. 7, any number of fluids can be mixed over successive periods of time.

While the invention has been illustrated by the description of one or more embodiments, and while the embodiments have been described in considerable detail, there is no intention to restrict nor in any way limit the scope of the appended claims to such detail. Additional advantages and modifications will readily appear to those who are skilled in the art. For example, in the described embodiments, the magnetic components 26, 146 have a circular shape. As will be appreciated, in alternative embodiments, the magnetic component may take on any shape or size depending on the desired mixing action and other application dependent variables. As will be further appreciated, the claimed invention is independent of the geometry and placement of the support bars 42, 44. In the described embodiment, an electromagnet

32 is used to drive respective magnetic components 26, 146; however, as will be appreciated, in an alternative embodiment, one magnet can be used to energize more than one magnetic component 26. In a further alternative embodiment, an electromagnet 32 can be replaced by an oscillating permanent magnet. The permanent magnet oscillations can be driven mechanically or magnetically.

Figure 6:
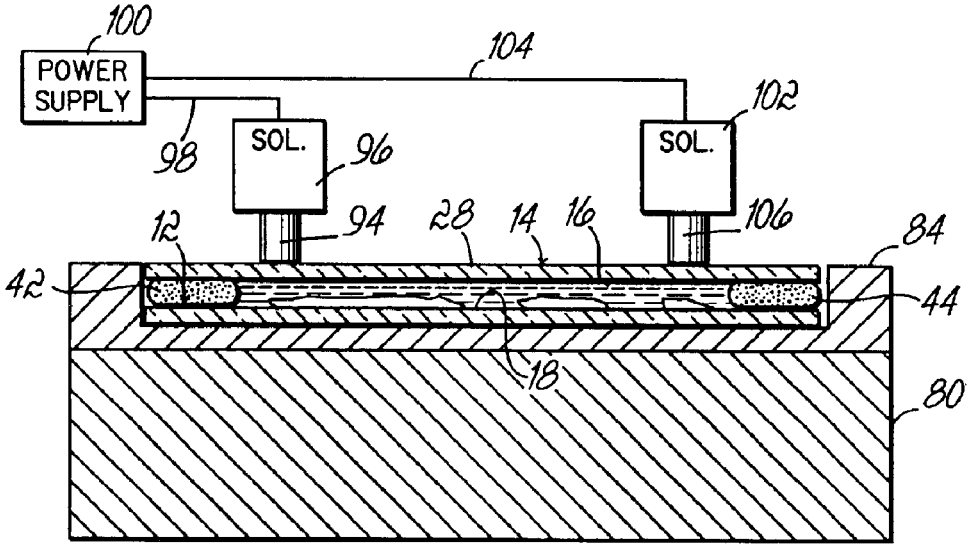
FIG. 6 is a schematic perspective view of a fifth embodiment of the cover slip mixing apparatus of FIG. 1.

Referring to FIG. 1, the flexing of the cover slip 14 is caused by magnetic forces created by one or more electromagnets 32 inducing a magnetic field in a magnetizable component 26 on the cover slip exterior surface 28. As will be appreciated, in alternative embodiments, the cover slip 14 may be flexed by forces produced by mechanical devices. For example, referring to FIG. 6, one end of an armature 94 of a solenoid 96 is disposed against the cover slip outer surface 28. The solenoid 96 is connected to an output 98 of a power supply 100. The power supply 100 provides an output signal to the solenoid 96 that can be varied in amplitude and frequency. Thus, the operation of the solenoid 96 causes an oscillation of the armature 94, thereby imparting an oscillation to the cover slip 14. Just as a plurality of magnetizable components can be disposed in different locations on the cover slip outer surface 28 to produce different patterns of mixing within the chamber 16, similarly one or more other solenoids 102 can be used to achieve similar results. Such other solenoid 102 is connected to an output 104 of the power supply 100, and the solenoid 102 has an armature 106 contacting the cover slip outer surface 28. Thus different mixing actions can be achieved within the chamber 16 by the operation of the solenoids 96, 102. As will be appreciated, in different applications, the end of the armatures 94, 106 can be disposed to simply contact the cover slip outer surface 28; or alternatively, the ends of the armatures can be bonded or otherwise affixed to the cover slip outer surface 28. Bonding agents can be used that provide either a rigid bond or a pliable bond as may be achieved with a silicone based material. The above alternative embodiments can also be implemented in the embodiment of FIG. 7.

Therefore, the invention in its broadest aspects is not limited to the detail shown and described. Consequently, departures may be made from the details described herein without departing from the spirit and scope of the claims which follow.

What is claimed is:

1. A cover slip mixing apparatus for containing an immobilized hybridizable material and a hybridization liquid to facilitate a hybridization reaction therebetween, the apparatus comprising:

a substrate comprising a surface on one side usable to hold the immobilized hybridizable material;

a flexible cover slip positioned over the surface;

at least two parallel spacer bars separating the surface of the substrate from the cover slip;

an unsealed chamber formed between the surface of the substrate, the cover slip and the spacer bars, the chamber comprising at least one open end adapted to receive a hybridization liquid covering the hybridizable material;

a magnetizable component attached to the cover slip over the surface of the substrate; and an electromagnet located on a side of the substrate opposite the cover slip and being operable to magnetize the magnetizable component and apply an electromagnetic force flexing the cover slip and causing a mixing action of the hybridization liquid in the chamber to facilitate the hybridization reaction.

2. The cover slip mixing apparatus of claim 1 wherein the spacer bars are printed on the cover slip.

3. The cover slip mixing apparatus of claim 1 wherein the device comprises:

a plurality of the magnetizable components; and a plurality of electromagnets, each electromagnet being associated with a magnetizable component.

4. The cover slip mixing apparatus of claim 1 wherein the magnetizable component comprises ferromagnetic ink printed on the cover slip.

5. The cover slip mixing apparatus of claim 1 wherein the spacer bars are magnetizable.

6. The cover slip mixing apparatus of claim 1 wherein the hybridizable material comprises a nucleic acid.

7. The cover slip mixing apparatus of claim 1 wherein the hybridizable material comprises a protein.

8. The cover slip mixing apparatus of claim 1 wherein the hybridizable material comprises a tissue.

9. The cover slip mixing apparatus of claim 1 wherein the hybridizable material is arranged within a microarray.

10. The cover slip mixing apparatus of claim 1 wherein the hybridization reaction occurs between complementary nucleic acids.

11. The cover slip mixing apparatus of claim 1 wherein the hybridization reaction occurs between an antibody and antigen.

12. The cover slip mixing apparatus of claim 1 wherein the spacer bars are attached to the cover slip.

13. The cover slip mixing apparatus of claim 1 wherein the substrate comprises a glass substrate.

* * * * *